US006659708B2

(12) United States Patent
Heiple

(10) Patent No.: US 6,659,708 B2
(45) Date of Patent: Dec. 9, 2003

(54) IMPLEMENT COUPLING ASSEMBLY

(75) Inventor: Ashley Heiple, Alum Bank, PA (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 09/880,303

(22) Filed: Jun. 13, 2001

(65) Prior Publication Data

US 2002/0192064 A1 Dec. 19, 2002

(51) Int. Cl.[7] ..... B66C 23/00
(52) U.S. Cl. ..... 414/723; 37/468; 403/321
(58) Field of Search ..... 414/723; 37/468; 403/321

(56) References Cited

U.S. PATENT DOCUMENTS 4,116,347 A * 9/1978 Uchida ..... 214/145 A
4,203,238 A * 5/1980 Bangert et al. ..... 37/118 R
4,204,794 A * 5/1980 Aoshiba ..... 414/723
4,854,813 A * 8/1989 Degeeter et al. ..... 414/723
5,400,531 A * 3/1995 Brown ..... 37/468
5,431,528 A * 7/1995 Jenkins et al. ..... 414/723
5,951,192 A * 9/1999 Collins ..... 403/150

* cited by examiner

*Primary Examiner*—Dean J. Kramer
*Assistant Examiner*—Michael Lowe
(74) *Attorney, Agent, or Firm*—Stevens, Davis, Miller & Mosher, LLP

(57) ABSTRACT

An assembly mountable on a machine consisting of an implement provided with opposed pin receiving recesses, a dipper stick connectable to the machine, a first connecting pin mounted in the dipper stick and receivable in one of the implement recesses, a support link pivotally connected to the dipper stick, an actuating link pivotally connected to the support link, a second connecting pin mounted in the actuating link and receivable in the other of the recesses, a base link rigidly connected to the second pin and detachably connectable to the first connecting pin and a fluid actuated assembly interconnecting the dipper stick and the support or actuating links whereby upon operation of the fluid actuated assembly, the pins will be caused to displace relative to each other to permit such pins to be inserted into and withdrawn from the implement recesses for coupling and uncoupling the implement relative to the dipper stick.

75 Claims, 10 Drawing Sheets

IMPLEMENT COUPLING ASSEMBLY

This invention relates to an improved coupler assembly and more particularly to an assembly for detachably coupling an implement such as a bucket, grapple, rake and the like to the dipper stick of a machine such as an excavating machine.

BACKGROUND OF THE INVENTION

In the construction, mining and other industries involved in bulk material handling, it has been a common practice to provide an assembly mountable on the dipper stick of a machine such as an excavating machine for quickly coupling and uncoupling different implements such as buckets, grapples, rakes and the like to permit a variety of work functions to be performed without incurring extensive downtime of the machine which results in lower productivity. Although there are many of such coupling assemblies in the prior art which are operable to readily couple and uncouple such implements, it has been found that such assemblies are not greatly desirable for a number of reasons. Often, they are complicated in design, difficult and expensive to manufacture and install and/or require extensive modification of the dipper stick of the machine and/or the implements to be coupled to the dipper stick. They further often add weight to the end of the dipper stick which correspondingly reduces the lift capacity of the machine and/or increase the displacement of the implement from the dipper stick which correspondingly reduces the penetrating force of the coupled implement. It thus has been desirable to provide a simple coupler assembly which may be readily mountable on a conventional dipper stick of a machine and detachably connected to a number of conventional implements without extensive modification of such dipper stick and implements.

SUMMARY OF THE INVENTION

Many conventional excavating machines generally are provided with a wheel or track mounted chassis, a support platform mounted on such chassis and usually swingable about a vertical axis, a boom pivotally connected to such platform for pivotal movement about a horizontal axis, a first fluid actuated cylinder assembly operatively interconnecting the machine platform and the boom, a handle or dipper stick pivotally connected to the end of such boom, a fluid actuated cylinder assembly operatively interconnecting the boom and the dipper stick, and an implement pivotally mounted on the end of the dipper stick. Typically, the implement is operable to pivot about a horizontal axis and is actuated by a fluid actuated cylinder assembly operatively interconnecting the dipper stick and the implement. Such actuating assembly conventionally has consisted of a cylinder member having a base end connected to an upper side of the dipper stick, a rod member pivotally connected to a pair of support links pivotally connected to sides of the dipper stick adjacent its free end and a pair of actuating links interconnecting the support links with the implement. Normally, the implement is provided with a pair of mounting brackets on an upper wall thereof, in which there is provided a pair of spaced pins for connecting the implement to the end of the dipper stick and the free ends of the actuating links. With the implement thus attached, it will be appreciated that by operating the various fluid actuated cylinder assemblies, the front end of the machine may be swung, the boom and dipper stick may be raised and lowered and the implement, often an excavating bucket, may be curled and uncurled relative to the dipper stick, in performing various work functions.

In such an arrangement, the present invention contemplates providing brackets on such implements having pairs of opposed pin receiving recesses or modifying the mounting pin brackets of conventional implements by removing the connecting pins therefrom and cutting away the upper portions of the brackets to provide an upperwardly opening recess having a pair of opposed recessed portions consisting of portions of the connecting pin seats, utilizing the end of the dipper stick to provide a first connecting pin insertable into one set of the opposed recessed portions of the implement mounting brackets, and providing a second connecting pin rotatably mounted in the actuating links and insertable in the other set of opposed recessed portions of the implement brackets, and a pair of spacer links rigidly connected at one set of ends thereof to the second connecting pin for pivotal movement therewith and attachably connectable at the other set of ends thereof to the first connecting pin.

With the spacer links attached to the first connecting pin and the connecting pins inserted in the implement bracket recesses, such spacer links cooperate with a portion of the dipper stick and the support and actuating links to form a four bar linkage, and by simply operating the cylinder assembly interconnecting the dipper stick and the support links, the implement may be curled and uncurled, in the conventional manner. With the spacer links detached from the first connecting pin, allowing a collapse of the linkage, the boom and dipper stick may be maneuvered and the cylinder assembly interconnecting the dipper stick and the support links may be operated to displace the connecting pins relative to each other and thus permit the connecting pins to be inserted into and withdrawn from the implement bracket recesses to correspondingly couple and uncouple implements to the dipper stick.

DETAILED DESCRIPTION OF THE PREFERRED EMBODIMENTS OF THE INVENTION

Figure 1:
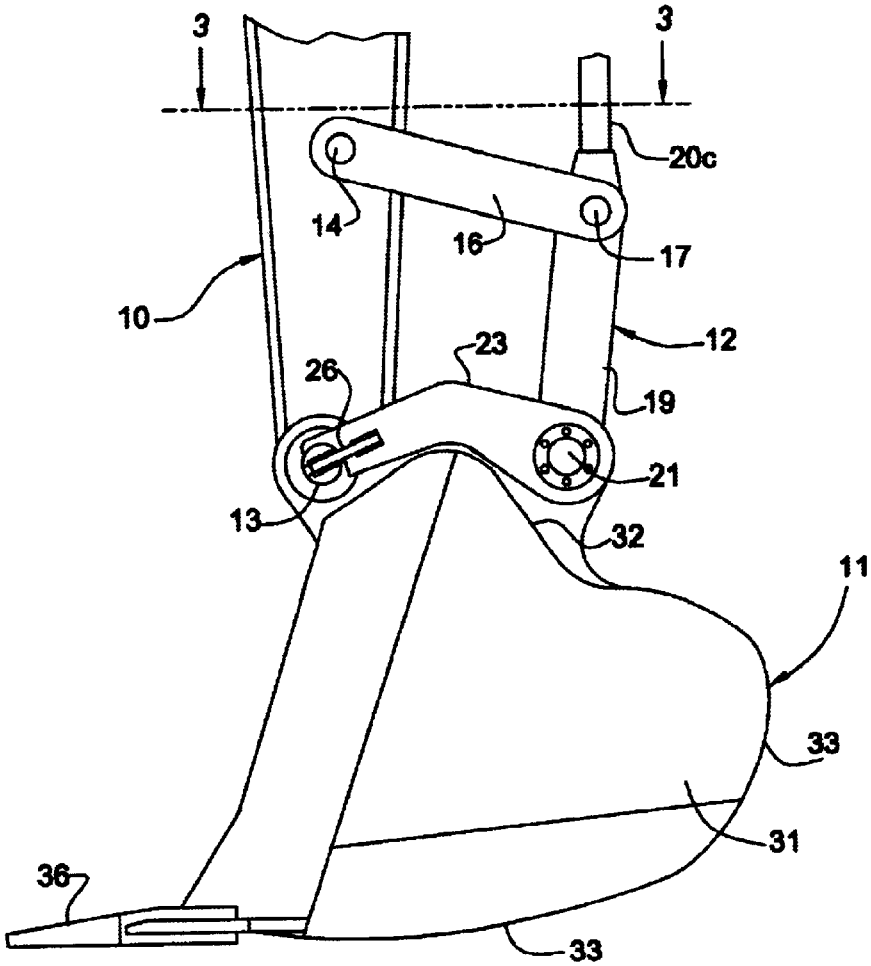
FIG. 1 is a side elevational view of an assembly embodying the present invention, coupling an excavating bucket to the dipper stick of an excavating machine.
Figure 1A:
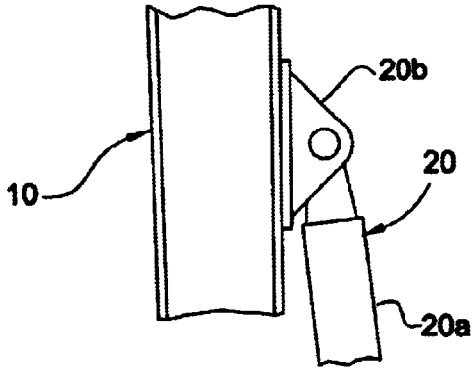
FIG. 1A is a side elevational view of the connection of the base end of the cylinder member of a fluid actuated assembly to the underside of the dipper stick shown in FIG. 1, having portions thereof broken away.
Figure 3:
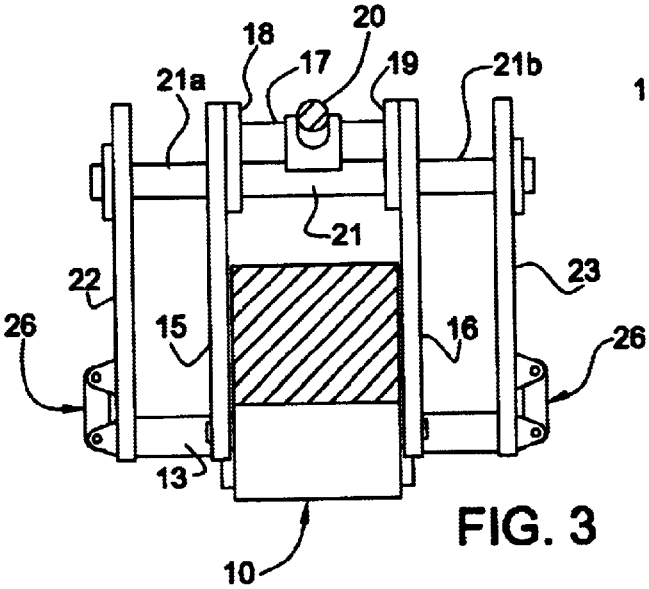
FIG. 3 is an enlarged cross sectional view taken along line 3—3 in FIG. 1.
Figure 2:
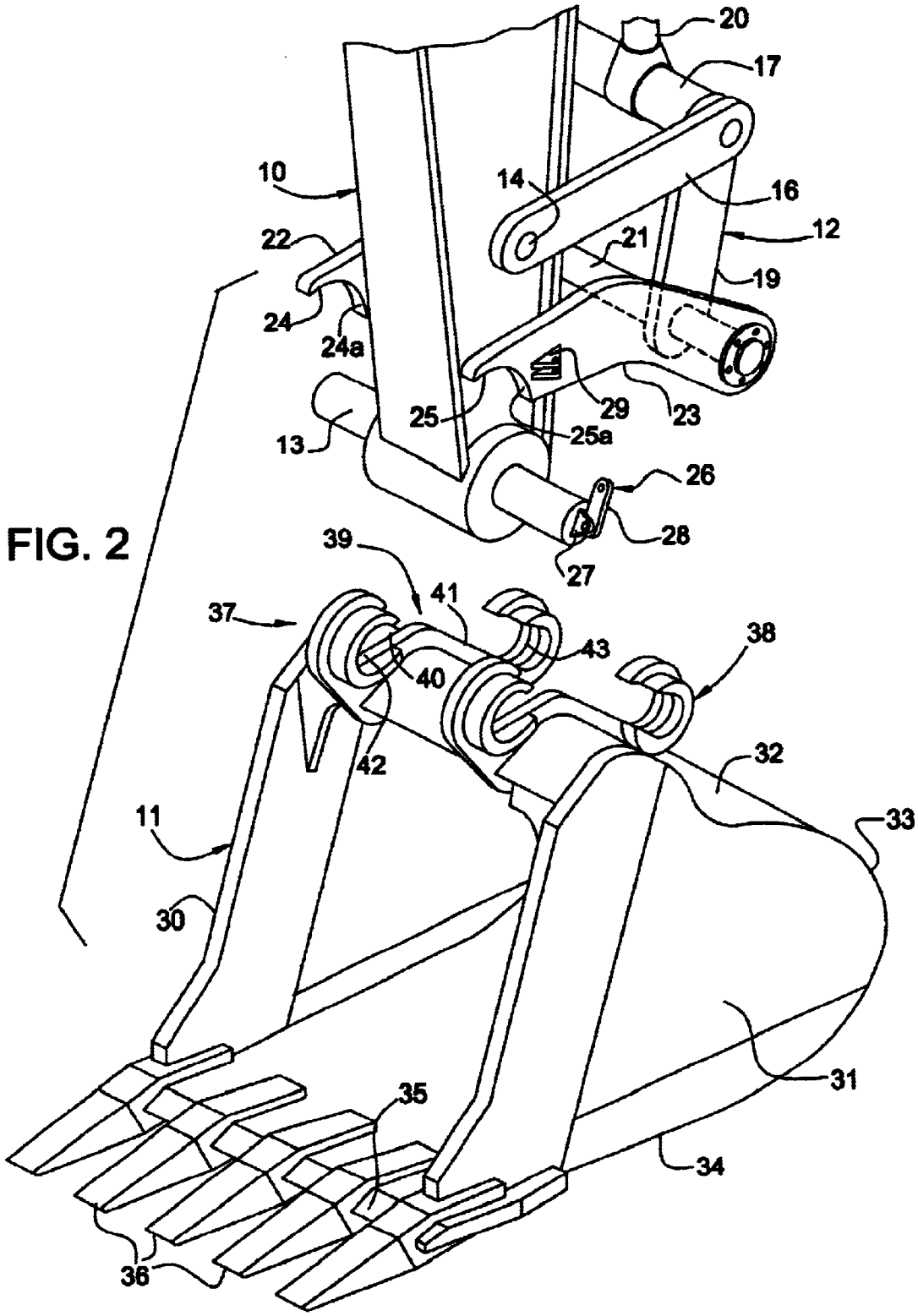
FIG. 2 is a perspective view of the embodiment of the invention shown in FIG. 1, illustrating the assembly in the uncoupled condition.

Referring to FIGS. 1 through 3 of the drawings, there is illustrated a dipper stick 10 of a excavating machine, an excavating bucket 11 and an assembly 12 for coupling the bucket on the free end of the dipper stick in the conventional manner. Dipper stick 10 is of a conventional construction and is pivotally connected at an upper end thereof to a boom, and is pivotal relative to such boom by means of a fluid actuated cylinder assembly. Rotatably mounted in the free end of dipper stick 10 is a first connecting pin 13 having a transversely disposed axis. Spaced from pin 13 is a mounting pin 14 having a transverse axis on which a pair of support links 15 and 16 are mounted for pivotal movement in parallel planes, relative to the dipper stick. The free ends of the support links are pivotally connected to a connecting pin 17 on which there also are pivotally connected the upper ends of a pair of actuating links 18 and 19. Operatively interconnecting the upper side of dipper stick 10 and connecting pin 17 is a fluid actuated cylinder assembly 20 including a cylinder member 20*a* having the base end thereof pivotally connected to a set of brackets 20*b* mounted on the underside of the dipper stick, and a rod member 20*c* pivotally connected at its free end to connecting pin 17.

Rotatably mounted in the lower ends of actuating links 18 and 19 is a connecting pin 21 having a transverse axis disposed parallel to the axes of connecting pins 13 and 17. A set of spacer links 22 and 23 are rigidly secured to the ends of connecting pin 21 and extend substantially radially relative thereto. The free ends of the spacer links are provided with forwardly and downwardly facing recesses 24 and 25 which are adapted to receive the outer ends of connecting pin 13 when such links are rotated in a counterclockwise direction about the axis of connecting pin 21. When the surfaces of recesses of 24 and 25 are seated on the outer ends of connecting pins 13, such links may be secured in such positions by a pair of latch mechanisms 26. Each of such latch mechanisms includes a small set of brackets 27 mounted on an end surface of connecting pin 13, a latch element 28 having an end thereof received within brackets 27 and pivotally connected thereto by means of a pin, and a set of brackets 29 in which the free end of the latch element may be received and secured by means of a pin when the surfaces of recesses 24 and 25 are seated on the ends of connecting pin 13.

With the surfaces of recesses 24 and 25 seated on the outer ends of connecting pin 13 and the free ends of the spacer links latched to the ends of connecting pin 13, the base links cooperate with a portion of the dipper stick disposed between connecting pin 13 and mounting pin 14, support links 15 and 16 and actuating links 18 and 19 to form a pair of laterally spaced four bar linkages. With such linkages thus intact, the cylinder assembly operatively interconnecting the underside of the dipper stick and connecting pin 17 may be operated to pivot spacer links 22 and 23 about the axis of connecting pin 13. When the spacer links are unlatched, operation of the cylinder assembly between the dipper stick and connecting pin 17 will cause support links 15 and 16 to pivot about the axis of mounting pin 14 and thus allow connecting pins 13 and 21 to displace relative to each other.

Bucket 11 is of a conventional configuration except for the mounting brackets. It is provided with a pair of laterally spaced side walls 30 and 31 and an adjoining wall including an upper wall section 32, a downwardly and forwardly curved, rear wall section 33 and a forwardly extending bottom wall section 34 terminating at a front cutting edge 35. Rigidly mounted on the front cutting edge is a set of laterally spaced teeth 36. Rigidly secured to the upper wall section 32 is a pair of identical, laterally spaced mounting brackets 37 and 38. As best seen in FIG. 2, mounting bracket 37 is recessed in an upper edge thereof as at 39 providing an entry or access way and a pair of lower guide surfaces 40 and 41 inclined toward a pair of opposed pin receiving recess portions 42 and 43. Such forwardly disposed recess portions are transversely aligned and are adapted to receive the end portions of connecting pin 13, and such rearwardly disposed recess portions also are transversely aligned and are adapted to receive end portions 21*a* and 21*b* of connecting pin 21, when the bucket is connected to the dipper stick as shown in FIG. 1.

With bucket 11 positioned on the ground and spacer members 22 and 23 unlatched from pin 13 as shown in FIG. 2, such bucket may be coupled to the dipper stick first by manipulating the dipper stick to insert the ends of connecting pin 13 in the forwardly disposed recess portions of the mounting brackets, and then operating the cylinder assembly 12 to insert and thus position end portions 21*a* and 21*b* of connecting pin 21 in the rearwardly disposed recess portions of the mounting brackets. When connecting pins 13 and 21 are thus positioned in mounting brackets 37 and 38, and the forward ends of links 22 and 23 are positioned with the wall portions of recesses 24 and 25 seated on the ends of connecting pin 13, the base members may be latched to connecting pin 13 to pivotally couple the bucket to the dipper stick.

In maneuvering the dipper stick to position the ends of connecting pin 13 in the forwardly disposed recess portions of the mounting brackets, the bottom wall edges of the bracket recesses, inclined toward the forwardly disposed recess portions, function to guide the ends of connecting pin 13 into the forwardly disposed recess portions of the bracket recesses. Similarly, the surfaces engaged by connecting pin end sections 21*a* and 21*b*, function to guide such pin sections into the rearwardly disposed recess portions of the mounting brackets. With the bucket thus coupled, the cylinder assembly interconnecting the underside of the dipper stick and assembly 12 may be operated to curl and uncurl the bucket in the conventional manner.

During pivotal movement of the dipper stick and/or the curling and uncurling of the bucket by means of the operation of the cylinder assembly interconnecting the dipper stick and assembly 12, the principal function of spacer links 22 and 23 is to maintain connecting pins 13 and 21 in the opposed recessed portions of the bucket mounting brackets. No substantial applied or reactive forces are transmitted through the spacer links. Instead, such forces are transmitted from the dipper stick to the bucket through connecting pins 13 and 21.

It will be appreciated that conventional excavating machines provided with a dipper stick, a bucket pivotally connected to the end of the dipper stick and a cylinder assembly operatively interconnecting the upper side of the dipper stick and the bucket through a set of actuating links supported on a pair of support links, may easily and comparatively inexpensively be modified to provide the coupling arrangement of the present invention, simply by providing a pair of mounting brackets similar to brackets 37 and 38 on the bucket, utilizing the lower ends of actuating links 18 and 19 to provide a rotatably mounted connecting pin 21, providing a pair of spacer links 22 and 23 rigidly connected to the ends of the connecting pin 21 rotatably mounted in the lower ends of the actuating links, utilizing the end portion of the dipper stick to provide a connecting pin 13 and providing a set of latching mechanisms 26 for securing the forwardly disposed ends of the spacer links to the ends of connecting pin 13.

Figure 5:
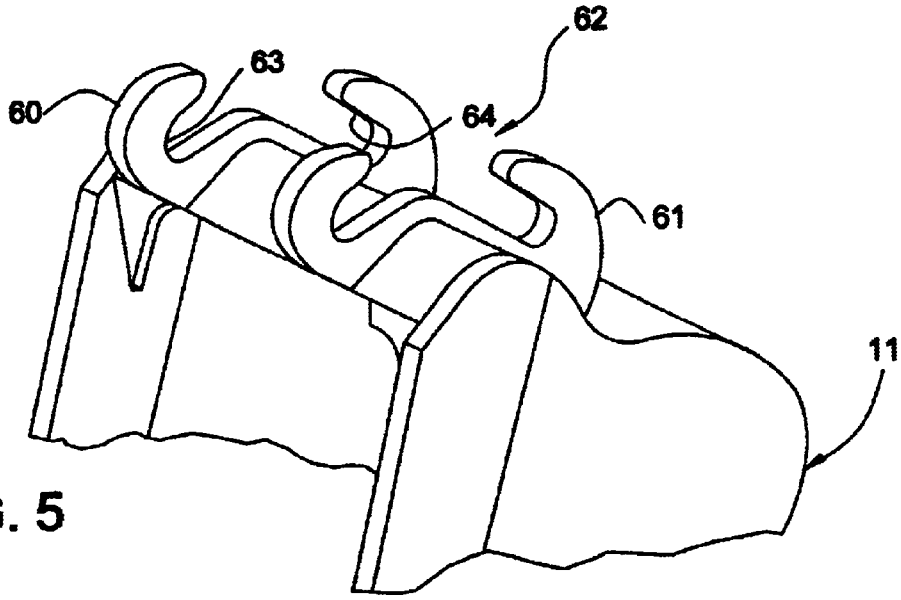
FIG. 5 is a perspective view of an implement provided with an alternate set of attachment brackets which may be utilized in the implement of the embodiment shown in FIGS. 1 and 2, having a portion thereof broken away.
Figure 6:
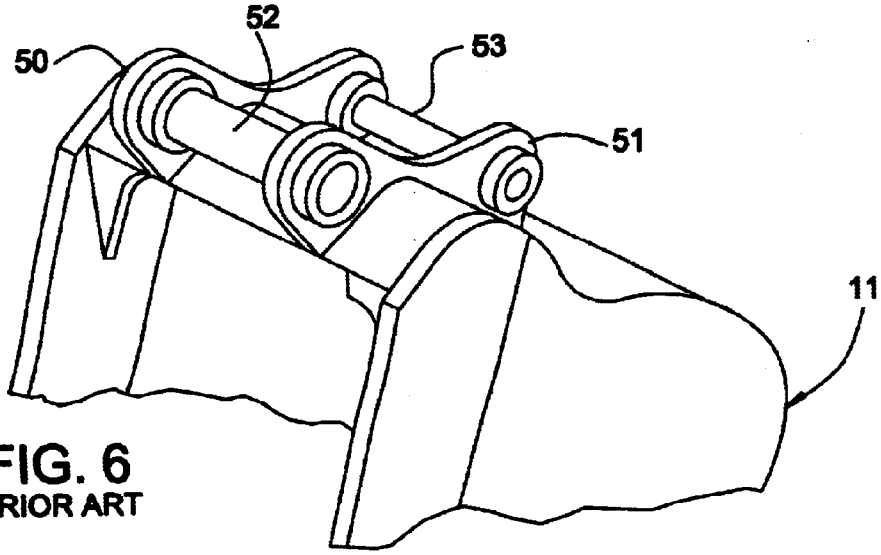
FIG. 6 PRIOR ART
FIG. 6 is a perspective view of a conventional implement having a set of attachment brackets which may be modified to provide the type of implement attachment brackets shown in FIGS. 1 and 2, having a portion thereof broken away.

FIG. 6 illustrates a conventional excavating bucket which may be modified to provide a bucket compatible with the present invention as shown in FIG. 2. Such conventional bucket typically includes a pair of laterally spaced mounting brackets 50 and 51 rigidly secured to the upper wall section of the bucket, and a pair of transversely disposed, longitudinally spaced connecting pins 52 and 53 mounted in suitable bracket openings. Such bucket may be modified to be compatible with the arrangement of the present invention simply by removing connecting pins 52 and 53 and then cutting recesses in the midportions of the upper edges of the brackets thereof communicating with the openings of connecting pins 52 and 53 to provide opposed recess portions and lower guide surfaces extending toward such opposed recess portions as shown in FIG. 2. Alternatively, and particularly for new bucket constructions, brackets of a configuration as shown in FIG. 5 may be provided which simply may be rigidly secured, usually by welding, to the upper wall section of a bucket. Similarly to mounting brackets 37 and 38, each of brackets 60 and 61 shown in FIG. 5 consists of a piece of metal of suitable length, depth and thickness, recessed at a midpoint in an upper edge thereof as at 62 to provide a pair of opposed recessed portions 63 and 64 and a pair of guide surfaces 65 and 66 which are inclined from a midpoint toward recessed portion 63 and 64, respectively.

Figure 4:
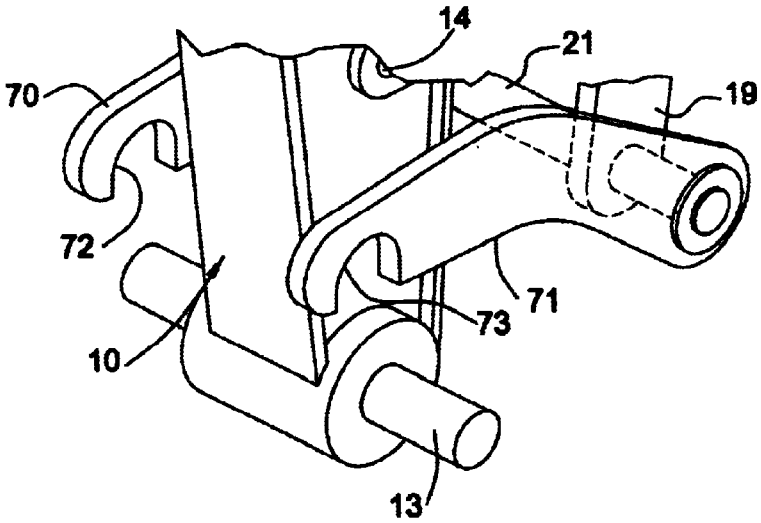
FIG. 4 is a perspective view of an alternate spacer link which may be utilized in the coupling assembly shown in FIGS. 1 through 3.

Connecting pins 13 and 21 are formed of hardened steel and are provided with sufficient tensile strength to carry the various loads imposed during typical digging operations. Spacer members 22 and 23 may be formed of carbon steel castings or may be formed from steel plate. To prevent undue wear of surfaces 24 and 25, hardened steel inserts 24*a* and 25*a* may be provided as shown in FIG. 2. In addition, in lieu of providing the forwardly disposed ends of spacer links 22 and 23 with forwardly and downwardly opening recesses 24 and 25, such links may be provided simply with downwardly opening recesses as shown in FIG. 4. Such figure illustrates spacer links 70 and 71 rigidly mounted at rear ends thereof to a connecting pin 21, having downwardly opening recesses 72 and 73 adapted to receive end portions of a connecting pin 13. As in the previously described embodiment, latch mechanisms would be provided to secure the front ends of base links 70 and 71 to connecting pin 13.

Referring to FIGS. 7 through 13, there is illustrated a dipper stick 80 of an excavating machine, an excavating bucket 81 and an assembly 82 for coupling the bucket to the free end of the dipper stick, incorporating another embodiment of the invention. Dipper stick 80 is similar in construction and operation to dipper stick 10 described in connection with the embodiment shown in FIGS. 1 through 6. Coupling assembly 82 includes a connecting pin 83, a mounting pin 84, a pair of connecting pins 85 and 86, a pair of support links 87 and 88, a pair of actuating links 89 and 90 and a pair of spacer links 91 and 92. Connecting pin 83 is mounted adjacent the free end of the dipper stick and is disposed transversely relative to the centerline of the dipper stick. Mounting pin 84 is spaced from and disposed parallel to connecting pin 83. Support links 87 and 88 are pivotally connected at one set of ends thereof to mounting pin 84, straddling the dipper stick, and are pivotally connected at an opposite set of ends thereof to connecting pin 85. Also connected to connecting pin 85 at one set of ends thereof are actuating links 89 and 90, inboard of support links 87 and 88. The opposite set of ends of the actuating links is pivotally connected to connecting pin 86. Spacer links on 91 and 92 are rigidly connected to the outer ends of connecting pin 86 and are adapted to engage the outer ends of connecting pin 83 in abutting relation and thus cooperate with a portion of the dipper stick, the support links and the actuating links to form a pair of four bar linkages. When the spacer links engage the outer ends of connecting pin 83 to form such linkages, assembly 82 may be pivoted relative to the dipper stick about the axis of connecting pin 83 by means of a hydraulic cylinder assembly operatively interconnecting the upper side of the dipper stick and assembly 82 by means of a rod member 93 pivotally connected to connecting pin 85 between support links 87 and 88.

Bucket 81 is provided on an upper wall portion thereof with a pair of mounting brackets 94 and 95 which are comparable to mounting brackets 37 and 38 described in connection with the embodiment shown in FIGS. 1 through 6, and are adapted to be engaged by assembly 82 to detachably couple bucket 81 to dipper stick 80. As in the previously described embodiment, the mounting brackets are provided with access openings 96 and 97 in the upper edges thereof, communicating with a first set of recesses 98 and 99 adapted to receive end portions of connecting pin 83, and a set of opposed recesses 100 and 101 adapted to receive the outer end portions of connecting pin 86 when assembly 82 is coupled to bucket 81.

Figure 7:
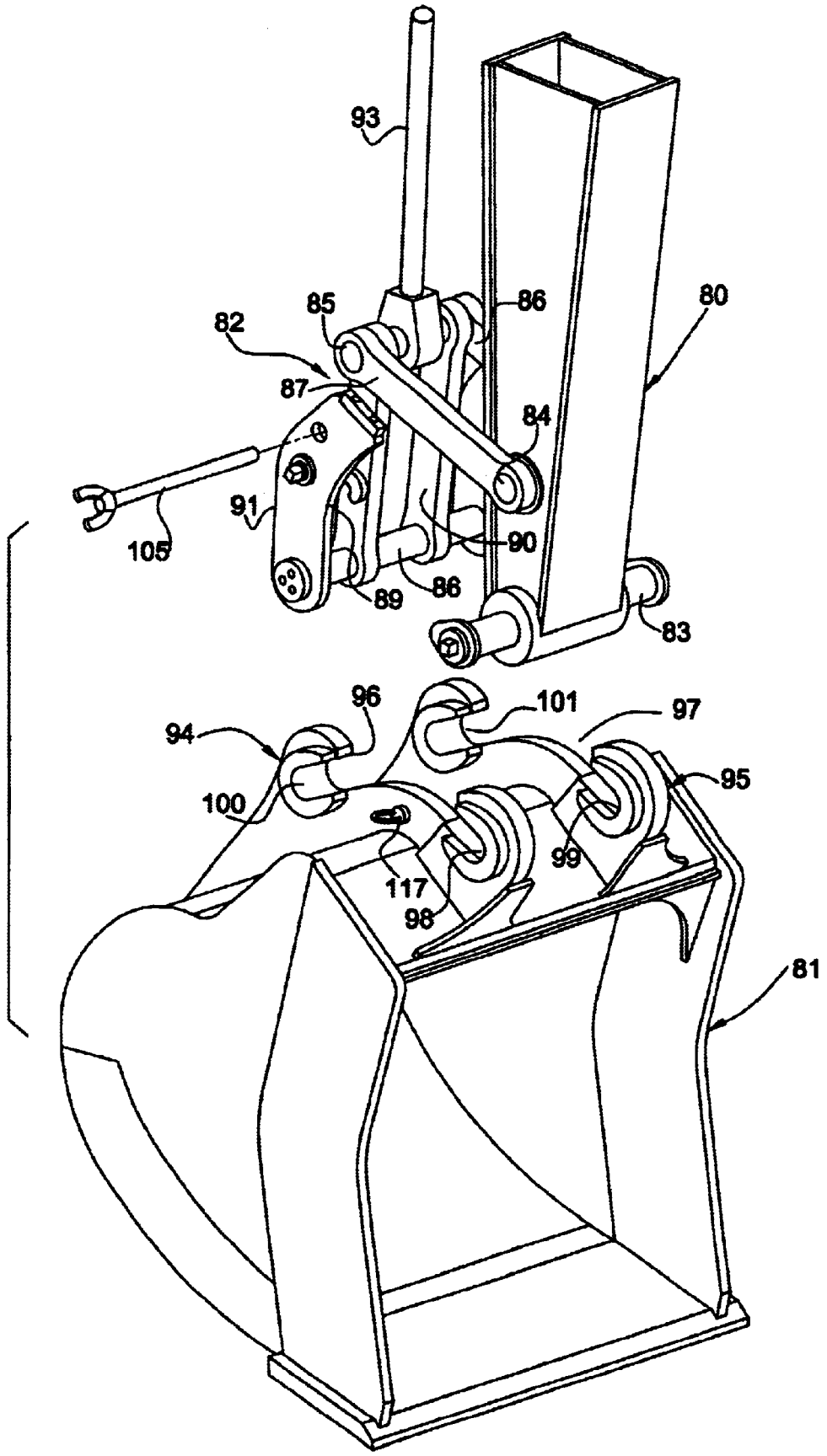
FIG. 7 is a perspective view of another embodiment of the present invention illustrating the implement uncoupled from the dipper stick of a machine.
Figure 8:
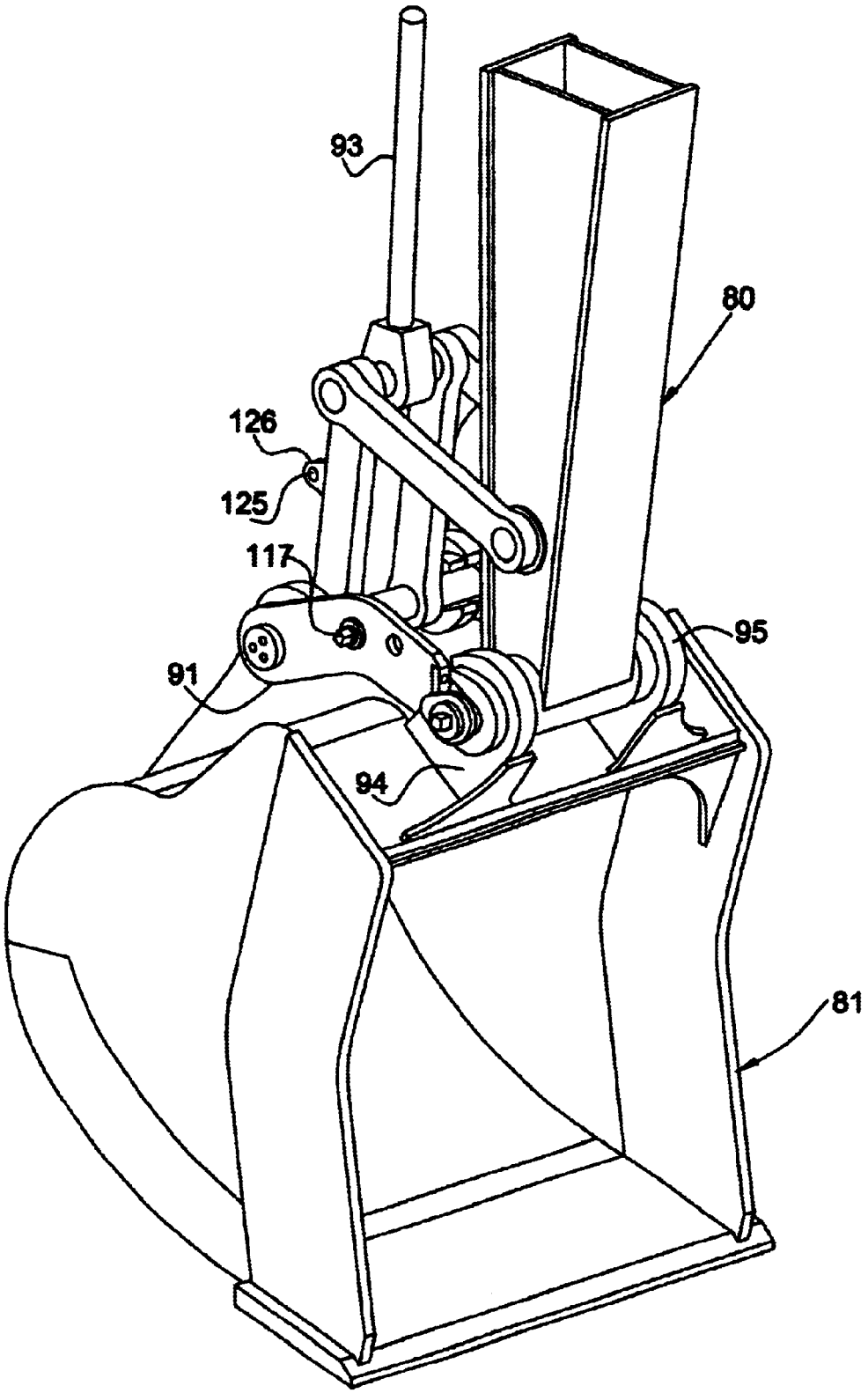
FIG. 8 is a view similar to the view shown in FIG. 7, illustrating the implement coupled to the dipper stick.
Figure 9:
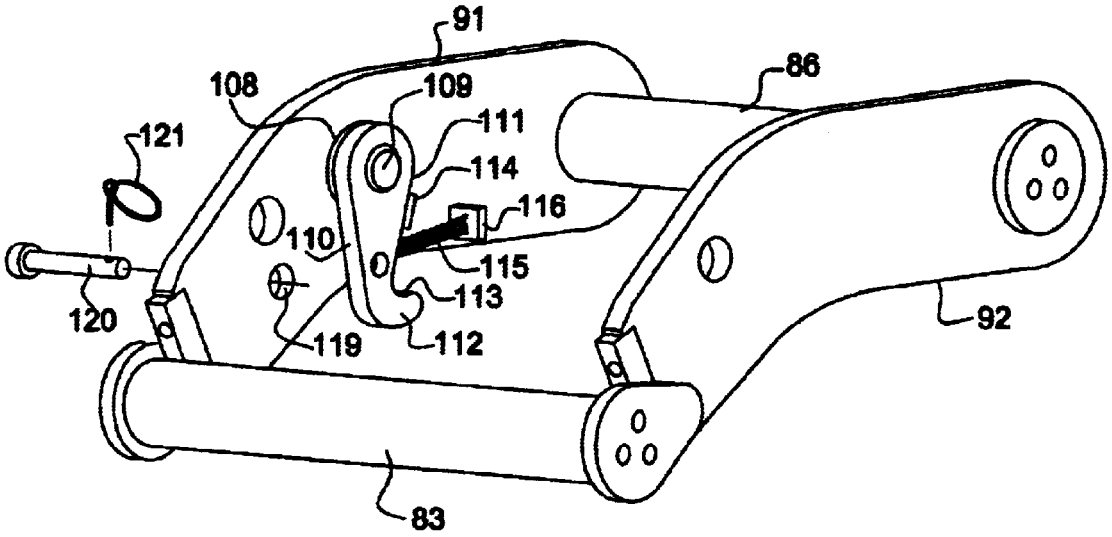
FIG. 9 is an enlarged, perspective view of the coupling assembly of the embodiment shown in FIGS. 7 and 8, shown from a right side.
Figure 10:
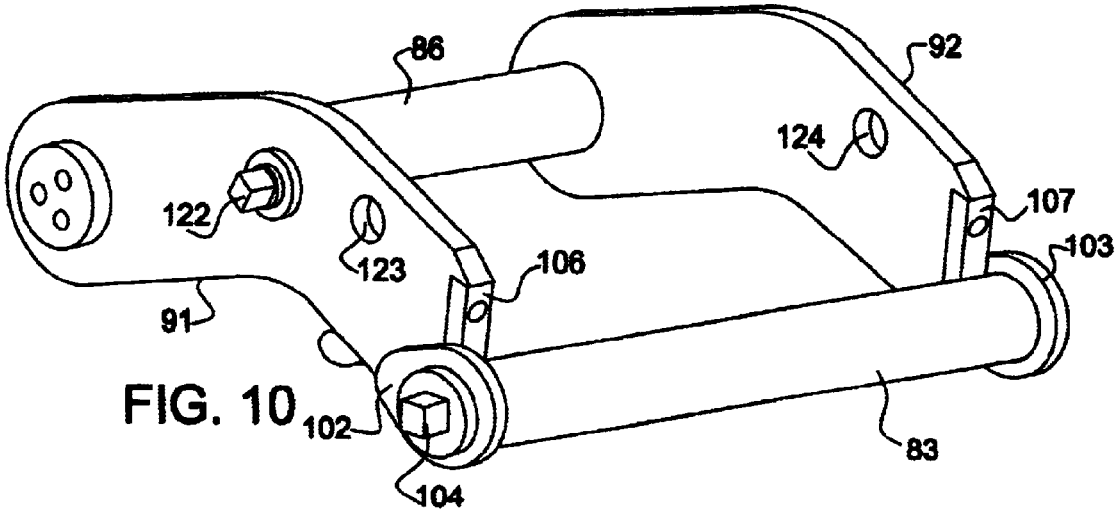
FIG. 10 is a view similar to the view shown in FIG. 9, shown from the left side.

As best shown in FIGS. 9 and 10, connecting pin 83 is provided with a pair of flanges 102 and 103 mounted on the ends thereof, and is formed with a set of flat surfaces adjacent such flanges which are adapted to be engaged by the free ends of the spacer links when assembly 12 is in the coupled or operative condition as shown FIG. 8, forming a four bar linkage. One end of connecting pin 83 is provided with a square head portion 104 which is adapted to be engaged by an open ended wrench 105, as shown in FIG. 7, to rotate the connecting pin and thus position the flat portions of the pin in alignment with the engaging front end portions of the spacer links.

The free ends of spacer links 91 and 92 are provided with hardened contact plates 106 and 107 which are adapted to engage the flat, aligned surfaces of connecting pin 83. Such plates may be secured to the front ends of the spacer links by means of a set of screws and further may be provided with shims to provide any necessary adjustment in the length of the spacer links to assure a firm engagement with the flat contact portions of connecting pin 83.

As best shown in FIG. 9, the inner side of spacer link 91 is provided with a latch element 108 which is secured to a pin 109 journaled in a transverse opening in link 91. The latch element has essentially a hook shaped configuration including a pair of converging side edges 110 and 111 terminating in a hook portion 112 curving from side edge 110 into an arcuate recessed portion 113 merging with opposite side edge 111. The latch element normally is biased in a clockwise direction relevant to FIG. 9, against a stop element 114 mounted on the inner side of link 91 by means of a spring 115 anchored on a small bracket 116 secured to the inner side of link 91.

The function of latch 108 is to maintain the front ends of spacer links 91 and 92 into engagement with the flat abutment surfaces of connecting pin 83 when assembly 12 is coupled to bucket 81 with connecting pin 83 received in recesses 98 and 99 of mounting brackets 94 and 95 and connecting pin 86 received in recesses 100 and 101 of the mounting brackets. This is accomplished by the latching element latching onto an eccentric roller 117 bolted on the outer side of mounting bracket 94 as shown in FIG. 7.

Figure 11:
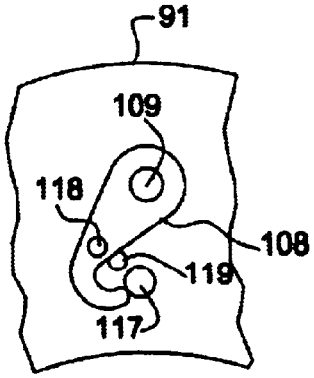
FIGS. 11, 12 and 13 are enlarged side elevational views of one of the spacer links shown in FIGS. 9 and 10, illustrating a latch member thereof in a position being cammed into a latched position, the latch member in a latched position and the latch member in an unlatched position, respectively, and having a portion thereof broken away.
Figure 12:
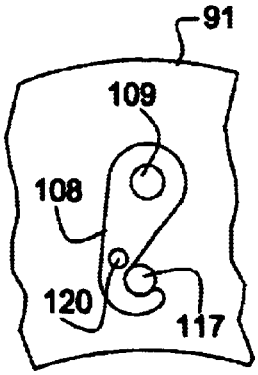
Figure 13:
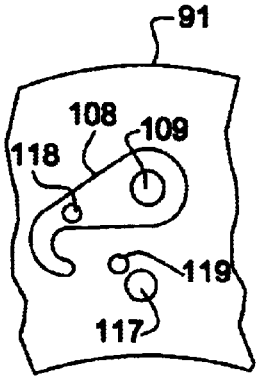

Latch element 108 is adapted to be cammed into a latching position with roller 107 when the coupling assembly is attached to the bucket and the spacer links are caused to pivot about the axis of connecting pin 86, as shown in FIG. 11, be locked in a latched position when assembly 12 is coupled to the bucket as shown in FIG. 12 and be released from the latched position to permit the uncoupling of the bucket as shown in FIG. 13. During the coupling of assembly 12 to the bucket and correspondingly the pivotal movement of the spacer links about the axis of pin 86, the curved end portion of the latch element will engage roller 84 and thus be cammed to rotate in a clockwise position against the biasing action of spring 15 to cause roller 117 to be received within recess 113 of the latch element when the spacer links pivot to their farthest travel into engagement with connecting pin 83, as shown in FIG. 12. With the latch element engaging roller 117 as shown in FIG. 12, an opening 118 in the latch element will register with an opening 119 in spacer link 91 to receive a locking pin 120 provided with a retention pin 121. When it is desired to free the spacer links to uncouple the bucket from the dipper stick, the latch element may be unlatched from roller 117 merely by removing the locking pin and rotating the latch element as shown in FIG. 13. Such rotation of the latch element may be accomplished with the use of wrench 105 applied to a square head portion 122 formed on the outer side of pin 109 as shown in FIG. 10.

When assembly 82 is in the inoperative condition as shown in FIG. 7, the spacer links may be retained in retracted, inoperative positions adjacent the outer sides of actuating links 89 and 90 by means of inserting the elongated shank portion of wrench 105 through a set of openings 123 and 124 adapted to register with a set of openings 125 provided in a set of brackets 126 mounted on the rear sides of actuating links 89 and 90.

With assembly 82 in the inoperative condition as shown in FIG. 7, the bucket may be connected to the dipper stick as shown in FIG. 8 initially by manipulating the dipper stick to insert the ends of connecting pin 83 into the forwardly disposed recess portions of the mounting brackets, and then operating the cylinder assembly to insert and thus position the end portions of connecting pins 86 in the rearwardly disposed recess portions of the mounting brackets. When connecting pins 83 and 86 have thus been positioned in the mounting brackets of the bucket, the spacer links may be released from their stored or retracted positions connected to the actuating links and permitted to pivot downwardly about the axis of connecting pin 86 so that the front ends thereof engage the flat portions of connecting pin 83. If the flat portions of connecting pin 83 are not properly aligned to be engaged by the front ends of the spacer links, pin 83 may be rotated by the use of wrench 105. As the spacer links thus pivot downwardly into position for maintaining connecting pins 83 and 86 in the recesses of the mounting brackets, the leading, rounded end portion of the latch element will engage roller 117, causing the latch element to pivot upwardly against the biasing action of spring 115, to permit the end of the latching element to ride over the roller and cause the roller to be received within recess 113 of the latch element as shown in FIG. 12. With the latch element in the latched position, locking pin 120 may be inserted through registered openings 119 and 120 and retaining pin 121 may be inserted through the locking pin to lock the spacer links in their operative position forming a four bar linkage. Under such conditions, the bucket will be pivotally connected to the dipper stick and the machine may be operated in the conventional manner to perform various excavating operations.

When it is desired to uncouple the bucket from the dipper stick, retaining pin 121 and locking pin 120 may be removed, wrench 105 may be applied to the head portion of pin 109 to pivot the latch element out of engagement with roller 117 as shown in FIG. 13 to free the spacer links and then the spacer links may be pivoted rearwardly alongside the actuating links where they may be retained by inserting the elongated shank portion of the wrench through registered openings in the spacer links and brackets on the rear end of actuating links.

Figure 14:
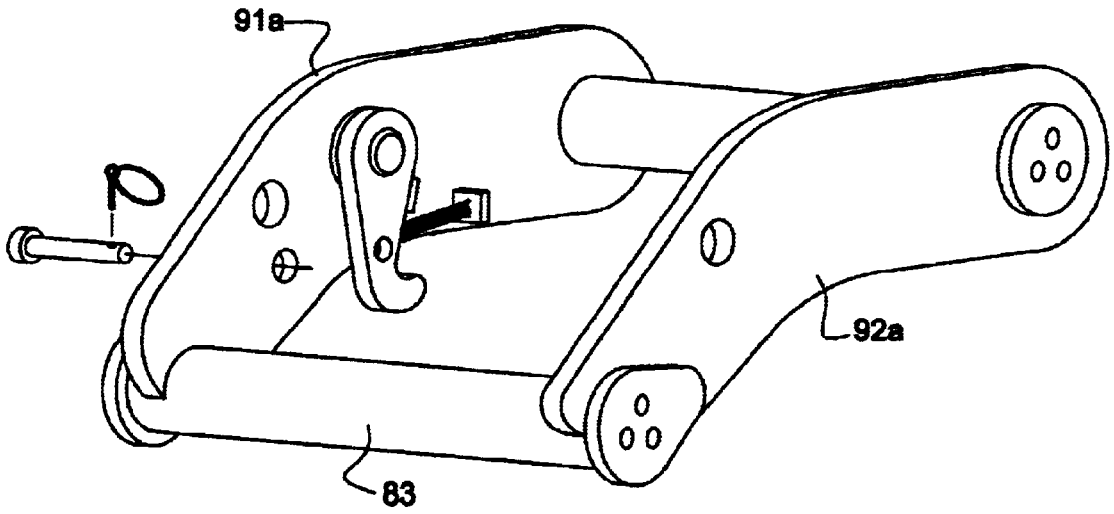
FIGS. 14 and 15 are views similar to the views shown in FIGS. 9 and 10, illustrating modifications thereof.
Figure 15:
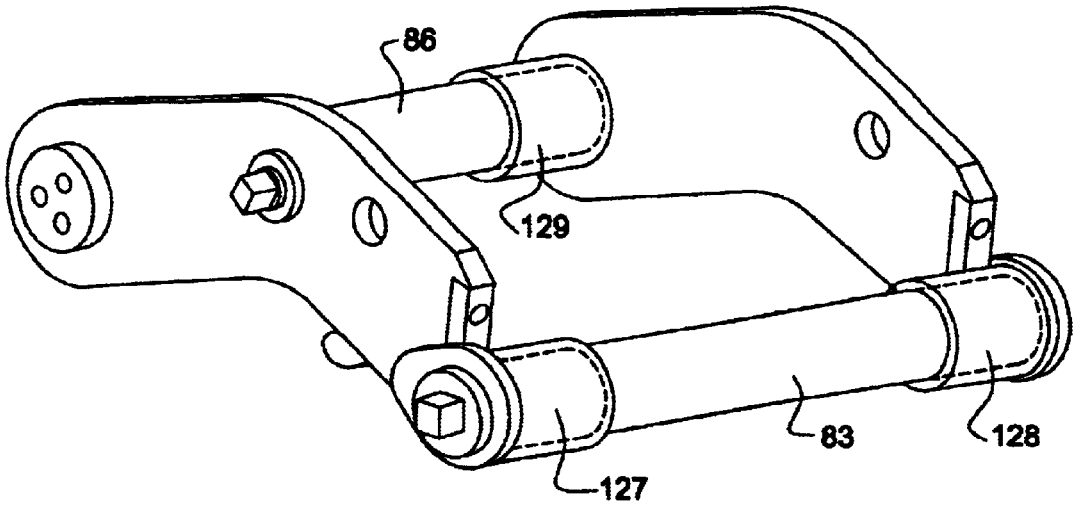

FIG. 14 illustrates a modification of the spacer links described in connection with the embodiment shown in FIGS. 7 through 13. The modification includes a set of spacer links 91*a* and 92*a* similar in construction and function to spacer links 91 and 92 with the exception of the configuration of the front end portions thereof. Such free end portions are formed with a configuration similar to the front end portions of spacer links 22 and 23 described in connection with the embodiment shown in FIGS. 1 through 6, providing forwardly and downwardly opening recesses adapted to receive the end portions of connecting pin 83. It further is contemplated that the front end portions of spacer links 91*a* and 92*a* may be formed with downwardly opening recesses formed adjacent the free ends thereof similar to the spacer links shown in FIG. 4, for receiving the end portions of connecting pin 83. FIG. 15 is another modification of the spacer link assemblies shown in FIGS. 9 and 10 in which a pair of bushings 127 and 128 may be mounted on the end portions of connecting pin 83 and a similar set of bushings 129, 129 may be mounted on the ends of connecting pin 86 to center coupling assembly 82 relative to the dipper stick.

Figure 16:
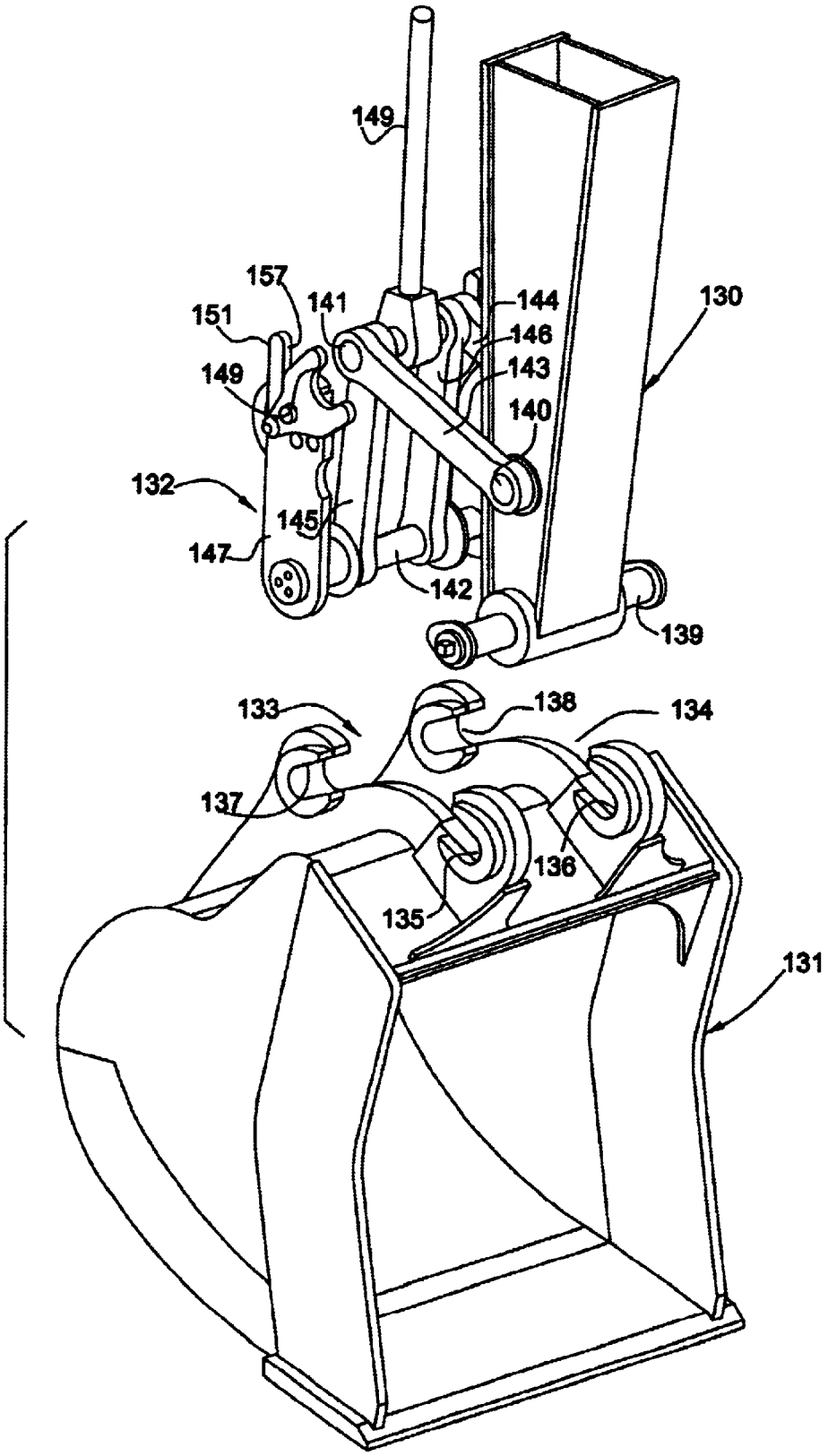
FIG. 16 is a perspective view of another embodiment of the invention, illustrating the assembly in the uncoupled condition.
Figure 17:
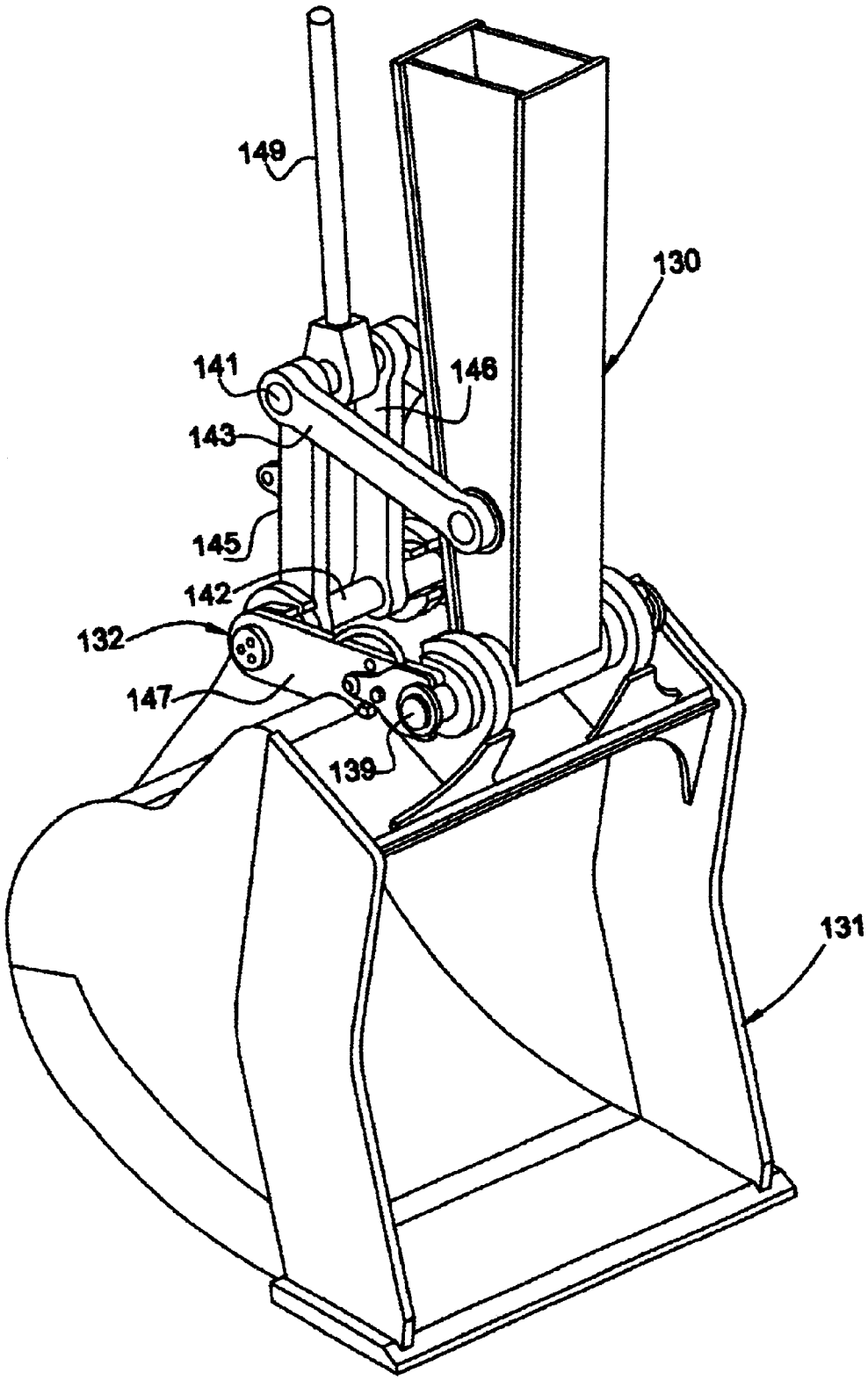
FIG. 17 is a view similar to the view shown in FIG. 16, illustrating the assembly in the coupled condition.
Figure 18:
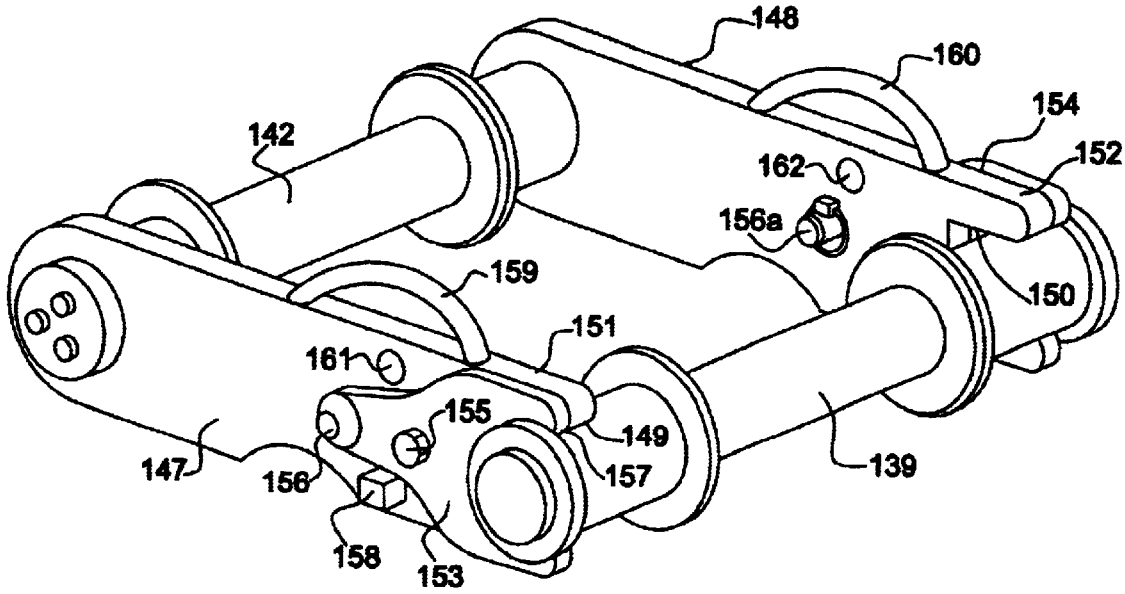
FIG. 18 is an enlarged perspective view of the coupling assembly shown in FIGS. 16 and 17, shown from the left side.

FIGS. 16 through 18 illustrate another embodiment of the invention which is similar to the embodiments shown in FIGS. 1 through 6 and 7 through 15 with the exception of the means for securing the free ends of the spacer links to the connecting pin mounted on the lower end of the dipper stick. Referring to such figures, there is illustrated a dipper stick 130 of an excavating machine, an excavating bucket 131 and an assembly 132 for coupling the bucket to the free end of the dipper stick. Dipper stick 130 is similar in construction and operation to dipper stick 10 described in connection with the embodiment shown in FIGS. 1 through 6. Bucket 131 is similar to bucket 11 described in connection with the embodiment shown in FIGS. 1 through 6 and is adapted to be engaged by assembly 132 to detachably couple the bucket to the dipper stick. As in the previously described embodiments, the mounting brackets of the bucket are provided with access openings 133 and 134 in the upper edges thereof, communicating with a first set of recesses 135 and 136 and a set of opposed recesses 137 and 138. As best shown in FIG. 16, the sides of the mounting brackets of the bucket are provided with bosses about the recesses therein to impart greater strength to the portions of the brackets adjacent the recesses therein.

Coupling assembly 132 includes a connecting pin 139, a mounting pin 140, a pair of connecting pins 141 and 142, a pair of support links 143 and 144, a pair of actuating links 145 and 146 and a pair of spacer links 147 and 148. Connecting pin 139 is mounted adjacent the free end of the dipper stick and is disposed transversely relative to the center line of the dipper stick. Mounting pin 140 is spaced from and disposed parallel to connecting pin 139. Support links 143 and 144 are pivotally connected at one set of ends thereof to mounting pin 140, straddling the dipper stick, and are pivotally connected at an opposite set of ends thereof to connecting pin 141. Also connected to connecting pin 141 at one set of ends thereof are actuating links 145 and 146, inboard of support links 143 and 144. The opposite set of ends of the actuating links is pivotally connected to connecting pin 142. Spacer links 147 and 148 are rigidly connected to outer ends of connecting pin 142 and are adapted to engage the outer ends of connecting pin 139 in abutting relation and thus cooperate with a portion of the dipper stick, the support links and the actuating links to form a pair of four bar linkages as in the previously described embodiments. When the spacer links engage the outer ends of connecting pin 139 to form such linkages, assembly 132 may be pivoted relative to the dipper stick about the axis of connecting pin 139 by means of a hydraulic cylinder assembly operatively interconnecting the upper side of the dipper stick and assembly 132 and provided with a rod member 149 pivotally connected to connecting pin 141 between support links 145 and 146.

Referring to FIG. 18, the lower portions of the free ends of spacer links 147 and 148 are recessed as at 150 which are adapted to receive an end portion of connecting pin 139, and provide a pair of projecting portions 151 and 152 adapted to rest on the ends of connecting pin 139 when such end portions are received within such recesses. Cooperating with the free ends of the spacer links is a pair of latch members 153 and 154, sometimes referred to "crow claws," each pivotally connected to an outer side of a spacer link. Latch member 153 is pivotally connected to spacer link 147 by means of a pin 155, and further is provided with an opening on one side of the pivotal connection of the member with the spacer link, which is adapted to register with an opening in spacer link 147 to receive a locking pin 156 therethrough for locking latch member 153 to spacer link 147 in the position as shown in FIG. 18. The portion of such member on the opposite side of pin 155 is provided with a recess 157 having a radius of curvature substantially similar to the radius of an end portion of connecting pin 139 so that when projecting portion 151 rests on an end of connecting pin 139 and latch member 153 is in its locked position, as shown in FIG. 18, the end portion of connecting pin 139 will be received within recess 157 to preclude the displacement of spacer link 147 relative to connecting pin 139 about the axis of connecting pin 142.

Latch member 153 is formed with a greater portion of its mass disposed on the side of the member including recess 157, relative to the axis of pin 155, so that when member 153 is unlocked from spacer link 147 and free to pivot about the axis of pin 155, it will be caused to pivot downwardly, engage a stop 158 and assume a position as shown in FIG. 16. Latch member 154 is similar in construction and mounting relative to latch member 153 and is adapted to pivot about the axis of a pivot pin disposed coaxially with pivot 155. Latch members 153 and 154 are adapted to pivot about an axis disposed parallel to the axis of connecting pin 139 and receive the end portions of connecting pin 139 in the recesses thereof, as the spacer links pivot about the axis of connecting pin 142 and projecting portions 151 and 152 thereof are caused to engage and rest on the outer ends of connecting pin 139.

The spacer links further are provided with a pair of handles 159 and 160 which may be gripped by an operator to pivot the links about the axis of connecting pin 142 to a storage position as shown in FIG. 16. They further are provided with a pair of transversely aligned openings 161 and 162 which are adapted to register with openings provided in actuating links 145 and 146 and openings in latch members 153 and 154 through which locking pins 156 and **156*a* may be received to lock the latch members in the position as shown in FIG. 18, when the spacer links are disposed in the positions shown in FIG. 16, so that locking pins 156 and 156*a* may be inserted through such registered openings to secure the spacer links in their stored positions as shown in FIG. 16**.

With bucket 131 positioned on the ground, the dipper stick positioned adjacent the upper end of the bucket and the spacer links in the stored positions as shown in FIG. 16, the bucket may be detachably connected to the dipper stick as shown in FIG. 17 by operating the cylinder assembly interconnecting coupling assembly 132 and the upper side of the dipper stick to cause connecting pins 139 and 142 to be drawn together a sufficient amount to permit them to be received within access openings 133 and 134 of the mounting brackets of the bucket, maneuvering the dipper stick to cause the end portions of connecting pin 139 to be received within recesses 135 and 136, operating the cylinder assembly connected to coupling assembly 132 to extend rod member 149 and thus cause connecting pin 142 to be received within recesses 137 and 138 of the mounting brackets, removing locking pins 156 and **156*a* to allow spacer links 147 and 148 to be freed from the actuating links and swing downwardly to engage the ends of the connecting pin 139 and then inserting locking pins 156 and 156*a* into registered openings in the latch members and spacer links to preclude the displacement of the spacer links relative to connecting pin 139**.

As the spacer links are freed from the actuating links by removing locking pins 156 and **156*a*, they will be caused to pivot downwardly about the axis of connecting pin 142, the upper surfaces of recesses of the latch members will first engage the outer ends of connecting pin 139 causing them to pivot upwardly about the common axis of their pivot pins, and then the lower surfaces of projecting portions 151 and 152 will engage the upper surfaces of the end portions of connecting pin 139 so that the spacer links will be positioned as shown in FIGS. 17 and 18. Locking pins 156 and 156*a* may then be inserted in registered openings in the latch members and spacer links to secure the spacer links to connecting pin 139. With the spacer links thus secured to connecting pins 139 and 142**, they will be prevented from being removed from the recesses in the mounting brackets of the bucket. The cylinder assembly operatively interconnecting the dipper stick and the coupling assembly may then be operated in the conventional manner to curl and uncurl the bucket relative to the dipper stick.

The function of the spacer links in each of the described embodiments is to retain the pins connected to the implement, in the recesses of the mounting brackets of the implement and allow them to pivot relative to the implement. Such links may be rigidly secured to either of such connecting pins or could be unsecured thereto, and can be detachably secured by latching or otherwise to either of such connecting pins or the implement to prevent their displacement during use.

It will be appreciated that the present invention provides an arrangement whereby a conventional excavating machine and a plurality of conventional implements including buckets, grapple, rakes and the like may be easily and inexpensively modified to permit such machines to easily couple and uncouple a variety of implements. Such arrangement involves not only simple modifications of the machine dipper stick and the implements to be coupled to the machine but the addition of only a few components.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly mountable on a machine comprising:

an implement provided with at least one pair of opposed pin receiving recesses;

a dipper stick operatively connectable to said machine for selected movements, having a first connecting pin rotatably mounted in an end thereof and receivable in one of said implement recesses;

at least one support link pivotally connected to said dipper stick;

at least one actuating link pivotally connected to said support link, having a second connecting pin rotatably mounted therein and receivable in the other of said implement recesses;

at least one spacer link connected to one of said connecting pins and disposable selectively in an inoperative position detached from said second connecting pin and in an operative position between said first and second connecting pins when said first and second connecting pins are disposed in said recesses, functioning to retain said first and second connecting pins in said recesses; and a fluid actuated assembly including a cylinder member having a base end pivotally connectable to said dipper stick and a rod member pivotally connected to at least one of said support and actuating links whereby when said spacer link is in said inoperative position, and upon operation of said fluid actuated assembly, said connecting pins will be caused to displace relative to each other along a linear line of travel intersecting the axes thereof to permit said pins to be inserted into and withdrawn from said recesses for correspondingly coupling and uncoupling said implement relative to said dipper stick upon manipulation of said dipper stick.

2. An assembly according to claim 1 wherein a portion of said dipper stick and said links form a four bar linkage upon the positioning of said spacer link in said operative condition.

3. An assembly according to claim 1 wherein said pivotal connection of said rod member to one of said support and actuating links, and said pivotal connection of said support and actuating links, are coaxial.

4. An assembly according to claim 1 including means for detachably securing said spacer link to at least one of said first and second connecting pins when said spacer link is disposed in said operative position.

5. An assembly according to claim 4 wherein said detachable securing means comprises a latch assembly.

6. An assembly according to claim 1 wherein said spacer link includes at least one recess having a surface engaging one of said first and second connecting pins when said spacer link is disposed in said operative position.

7. An assembly according to claim 6 including means for detachably securing said spacer link to at least one of said first and second connecting pins when said spacer link is in said operative position.

8. An assembly according to claim 6 wherein said spacer link recess has a curved surface engageable with said first connecting pin.

9. An assembly according to claim 8 wherein said curved surface engageable with said first connecting pin has a radius of curvature substantially similar to the radius of said first connecting pin.

10. An assembly according to claim 6 including means for detachably securing said spacer link to said implement when said spacer link is in said operative position.

11. An assembly according to claim 1 wherein said spacer link is rigidly connected to one of said first and second connecting pins.

12. An assembly according to claim 11 including means for detachably securing said spacer link to the other of said first and second connecting pins when said spacer link is disposed in said operative position.

13. An assembly according to claim 12 wherein said detachable securing means comprises a latch assembly.

14. An assembly according to claim 11 wherein said spacer link includes at least one recess having a surface engaging said other of said first and second connecting pins when said spacer link is disposed in said operative position.

15. An assembly according to claim 14 wherein said recess opens forwardly and downwardly.

16. An assembly according to claim 14 including means for detachably securing said spacer link to the other of said first and second connecting pins when said spacer link is in said operative position.

17. An assembly according to claim 14 wherein said recess opens downwardly.

18. An assembly according to claim 14 including means for detachably securing said spacer link to said implement when said spacer link is in said operative position.

19. An assembly according to claim 11 including means for detachably securing said spacer link to said implement when said spacer link is disposed in said operative position.

20. An assembly according to claim 19 wherein said detachable securing means comprises a latch assembly.

21. An assembly according to claim 20 wherein said latch assembly includes a roller mounted on said implement and a latch element pivotally mounted on said spacer link, normally biased against a stop in a first rotational direction and operable to be cammed in a second rotational direction upon engagement with said roller, to catch said roller, when said spacer link is displaced into said operative position.

22. An assembly according to claim 1 wherein said implement includes surfaces engageable by said connecting pins for guiding said connecting pins towards said recesses.

23. An assembly according to claim 1 wherein said implement includes at least one mounting bracket rigidly secured to an upper wall thereof including said opposed recesses.

24. An assembly according to claim 1 including a pair of support links coaxially, pivotally connected to opposite sides of said dipper stick, a pair of actuating links each pivotally connected to a support link and pivotally connected to said second connecting pin and a pair of spacer links each disposable in an operative position between said first and second connecting pins when said first and second connecting pins are disposed in said recesses, and wherein said rod member is pivotally connected to at least one of said support and actuating link.

25. An assembly according to claim 24 wherein a portion of said dipper stick and said links comprise a pair of laterally spaced, four bar linkages.

26. An assembly according to claim 24 including means for latching at least one of said spacer links to one of said first and second connecting pins.

27. An assembly according to claim 24 including a third connecting pin to which said support and actuating links and said rod member are pivotally connected.

28. An assembly according to claim 24 wherein each of said spacer links is spaced laterally from said dipper stick and a connected actuating link for receiving portions of said implement therebetween when said first and second connecting pins are disposed in said operative positions.

29. An assembly according to claim 24 wherein said implement includes surfaces engageable by said first and second connecting pins for guiding said first and second connecting pins toward said implement recesses.

30. An assembly according to claim 24 including a pair of brackets mounted on said implement each including an entry way communicating with said pair of opposed recess portions.

31. An assembly according to claim 30 wherein each of said brackets includes surfaces engageable by said first and second connecting pins inserted through said entry way for guiding said connecting pins into said opposed recess portion therein.

32. An assembly according to claim 1 including means for detachably securing said spacer link to said implement when said spacer link is disposed in said operative position.

33. An assembly according to claim 32 wherein said detachable securing means comprises a latch assembly.

34. An assembly according to claim 33 wherein said latch assembly includes a roller mounted on said implement and a latch element pivotally mounted on said spacer link, normally biased against a stop in a first rotational direction and operable to be cammed in a second rotational direction upon engagement with said roller, to catch said roller, when said spacer link is displaced into said operative position.

35. An assembly according to claim 1 including a latch member pivotally connected to said spacer link, having a recess receiving said first connecting pin when said spacer link is disposed in said operative position.

36. An assembly according to claim 35 wherein said latch member is pivoted about an axis disposed parallel to the axis of said first connecting pin.

37. An assembly according to claim 35 including means for detachably securing said latch member to said spacer link when said spacer link is in said operative position and said first connecting pin is received in said recess of said latch member.

38. An assembly according to claim 35 including means for detachably securing said spacer link to said actuating link when said spacer link is in an inoperative position.

39. An assembly according to claim 35 wherein said recess has a curved surface engageable with said first connecting pin.

40. An assembly according to claim 39 wherein said curved surface has a radius of curvature substantially similar to the radius of said first connecting pin.

41. An assembly according to claim 35 including means for positioning said latch member relative to said spacer link whereby upon displacement of said spacer link from an inoperative to said operative position, a portion of a surface of said recess will engage said first connecting pin and thus cause said latch member to pivot relative to said spacer link to receive said first connecting pin within said recess.

42. An assembly according to claim 41 wherein said positioning means comprises a stop disposed on said spacer link engageable by said latch member.

43. An assembly mountable on a dipper stick operatively connected to a machine, having a fluid actuated cylinder assembly including a rod member, and connectable to an implement having at least one pair of opposed, connecting pin receiving recesses, comprising:

a first connecting pin rotatably mountable in said dipper stick and receivable in one of said implement recesses;

at least one support link pivotally connectable to said dipper stick;

an actuating link pivotally connected to said support link;

a second connecting pin rotatably mounted in said actuating link and receivable in the other of said implement recesses;

means for pivotally connecting at least one of said support and actuating links to said rod member; and a spacer link disposable in an operative position between said first and second connecting pins when said first connecting pin is mounted in said dipper stick, and received in one of said recesses, said support link is pivotally connected to said dipper stick, said second connecting pin is received in the other of said recesses and at least one of said support and actuating links is pivotally connected to said rod member, in an assembled condition and an inoperative position detached from one of said connecting pins, allowing said connecting pins to be displaced relative to each other along a linear line of travel intersecting the axes thereof and correspondingly selectively be inserted into and withdrawn from said recesses in attaching and detaching said implement to and from said dipper stick.

44. An assembly according to claim 43 wherein a portion of said dipper stick and said links form a four bar linkage when said pins and links are in said assembled condition.

45. An assembly according to claim 43 wherein said pivotal connection of said rod member to one of said support and actuating links, and said pivotal connections of said support and actuating links, are coaxial.

46. An assembly according to claim 43 including means for detachably securing said spacer link to at least one of said first and second connecting pins when said spacer link is disposed in said operative position.

47. An assembly according to claim 46 wherein said detachable securing means comprises a latch assembly.

48. An assembly according to claim 43 wherein said spacer link includes at least one recess having a surface engaging one of said first and second connecting pins when said spacer link is disposed in said operative position.

49. An assembly according to claim 48 including means for detachably securing said spacer link to at least one of said first and second connecting pins when said spacer link is in said operative position.

50. An assembly according to claim 48 including means for detachably securing said spacer link to said implement when said spacer link is in said operative position.

51. An assembly according to claim 43 said spacer link is rigidly connected to one of said first and second connecting pins.

52. An assembly according to claim 51 including means for detachably securing said spacer link to the other of said first and second connecting pins when said spacer link is disposed in said operative position.

53. An assembly according to claim 52 wherein said detachable securing means comprises a latch assembly.

54. An assembly according to claim 53 wherein said latch assembly includes a roller mounted on said implement and a latch element pivotally mounted on said spacer link, normally biased against a stop in a first rotational direction and operable to be cammed in a second rotational direction upon engagement with said roller, to catch said roller, when said spacer link is displaced into said operative position.

55. An assembly according to claim 51 wherein said spacer link includes at least one recess having a surface engaging said other of said first and second connecting pins when said spacer link is disposed in said operative position.

56. An assembly according to claim 55 including means for detachably securing said spacer link to the other of said first and second connecting pins when said spacer link is in said operative position.

57. An assembly according to claim 55 including means for detachably securing said spacer link to said implement when said spacer link is in said operative position.

58. An assembly according to claim 51 including means for detachably securing said spacer link to said implement when said spacer link is disposed in said operative position.

59. An assembly according to claim 58 wherein said detachable securing means comprises a latch assembly.

60. An assembly according to claim 43 including a pair of support links coaxially, pivotally connectable to opposite sides of said dipper stick, a pair of actuating links each pivotally connected to a support link and pivotally connected to said second connecting pin and a pair of spacer links disposable in an operative condition between said first and second connecting pins when said first connecting pin is mounted in said dipper stick and received in said one of said recesses said support links are pivotally connected to said dipper stick, said second connecting pin is received in the other of said recesses and at least one of said support and actuating links is pivotally connected to said rod member, in an assembled condition.

61. An assembly according to claim 60 wherein a portion of said dipper stick and said links form a pair of four bar linkages when said pins and links are in said assembled condition.

62. An assembly according to claim 60 including a third connecting pin to which said support and actuating links are pivotally connected and to which said rod member is connectable.

63. An assembly according to claim 60 wherein each of said spacer links includes at least one recess having a surface engaging one of said first and second connecting pins when said spacer links are in their operative position.

64. An assembly according to claim 63 wherein said recesses open forwardly and downwardly.

65. An assembly according to claim 63 wherein said recesses open downwardly.

66. An assembly according to claim 60 including means for latching said spacer links to said first connecting pin.

67. An assembly according to claim 43 including means for positioning said latch member relative to said spacer link whereby upon displacement of said spacer link from an inoperative to said operative position, a portion of a surface of said recess will engage said first connecting pin and thus cause said latch member to pivot relative to said spacer link to receive said first connecting pin within said recess.

68. An assembly according to claim 67 wherein said positioning means comprises a stop disposed on said spacer link engageable by said latch member.

69. An assembly according to claim 43 including means for detachably securing said spacer link to said implement when said spacer link is disposed in said operative position.

70. An assembly according to claim 69 wherein said detachable securing means comprises a latch assembly.

71. An assembly according to claim 70 wherein said latch assembly includes a roller mounted on said implement and a latch element pivotally mounted on said spacer link, normally biased against a stop in a first rotational direction and operable to be cammed in a second rotational direction upon engagement with said roller, to catch said roller, when said spacer link is displaced into said operative position.

72. An assembly according to claim 43 including a latch member pivotally connected to said spacer link, having a recess receiving said first connecting pin when said spacer link is disposed in said operative position.

73. An assembly according to claim 43 wherein said latch member is pivoted about an axis disposed parallel to the axis of said first connecting pin.

74. An assembly according to claim 43 including means for detachably securing said latch member to said spacer link when said spacer link is in said operative position and said first connecting pin is received in said recess of said latch member.

75. An assembly according to claim 43 including means for detachably securing said spacer link to said actuating link when said spacer link is in an inoperative position.

* * * * *